US009988782B2

(12) United States Patent
Schmidt

(10) Patent No.: US 9,988,782 B2
(45) Date of Patent: Jun. 5, 2018

(54) METHOD AND APPARATUS FOR SKIMMING A FLOATING LIQUID FROM A BODY OF WATER

(71) Applicant: Lawrence Schmidt, Port Coquitlam (CA)

(72) Inventor: Lawrence Schmidt, Port Coquitlam (CA)

( * ) Notice: Subject to any disclaimer, the term of this patent is extended or adjusted under 35 U.S.C. 154(b) by 389 days.

(21) Appl. No.: 14/745,577

(22) Filed: Jun. 22, 2015

(65) Prior Publication Data

US 2016/0215468 A1 Jul. 28, 2016

(30) Foreign Application Priority Data

Jan. 22, 2015 (CA) ..... 2879312

(51) Int. Cl.
*C02F 1/00* (2006.01)
*E02B 15/04* (2006.01)

(52) U.S. Cl.
CPC ..... *E02B 15/048* (2013.01)

(58) Field of Classification Search
None
See application file for complete search history.

(56) References Cited

U.S. PATENT DOCUMENTS

| | | | | |
|---|---|---|---|---|
| 3,534,859 | A | 10/1970 | Amero et al. | |
| 3,547,553 | A | 12/1970 | Stanfield | |
| 3,613,891 | A * | 10/1971 | Cloutier | E02B 15/104 210/242.3 |
| 3,722,687 | A | 3/1973 | Stebbins et al. | |
| 3,722,688 | A | 3/1973 | Wirsching | |
| 3,830,370 | A | 8/1974 | Glaeser et al. | |
| 4,024,063 | A | 5/1977 | Mori | |
| 5,217,611 | A * | 6/1993 | Ayroldi | E02B 15/047 210/242.1 |
| 5,484,521 | A * | 1/1996 | Kramer | B01D 17/0217 210/360.1 |

* cited by examiner

*Primary Examiner* — Richard C Gurtowski
(74) *Attorney, Agent, or Firm* — Davis & Bujold PLLC; Michael J. Bujold

(57) ABSTRACT

A method for skimming a target liquid floating on water involves a first step of providing a body having a first compartment and a second compartment. The body has floats, such that the body floats on the water. The body has an opening through which liquids enter the first compartment. The body has a target liquid transfer apparatus to transfer the target liquid from the first compartment to the second compartment. A second step involves setting the target liquid transfer apparatus a predetermined distance above a water level in the first compartment to selectively transfer only the target liquid floating on the water from the first compartment to the second compartment.

14 Claims, 11 Drawing Sheets

METHOD AND APPARATUS FOR SKIMMING A FLOATING LIQUID FROM A BODY OF WATER

FIELD

There is described a method and associated apparatus that skims a floating liquid from a surface of a body of water. This method was developed for use in tailings ponds, but has wider application.

BACKGROUND

A number of methods and apparatus have previously been proposed for skimming a floating liquid from a body of water, such as: U.S. Pat. No. 4,024,063 (Mori) and U.S. Pat. No. 3,722,687 (Stebbins et al).

There will hereinafter be described an alternative method and an apparatus that has been developed in accordance with the teachings of the method.

SUMMARY

According to one aspect there is provided a method for skimming a target liquid floating on water, such as the water of a pond. The method involves as a first step, providing a spillway bar with adjustable floats to set the thickness of a target fluid to be collected. A second step involves providing a body having a first compartment and a second compartment. The body also has adjustable floats, such that the body floats on the water at a predetermined height. The body has an opening through which liquids enter the first compartment. The body has a target liquid transfer apparatus to transfer the target liquid from the first compartment to the second compartment. A second step involves setting the target liquid transfer apparatus a predetermined distance above the water level of the pond to selectively transfer only the target liquid floating on the water from the first compartment to the second compartment.

The philosophy behind this method is that only the target liquid must be skimmed. As soon as you take in some water, even small amounts, problems arise. The target liquid transfer apparatus is always drawing liquid from above the water level, so it is always drawing only the target liquid. Any water in the first compartment will be extremely low in volume, as it will be only from accidental introduction.

The target liquid transfer apparatus continuously removes the target liquid, leaving the water behind. It is, therefore, preferred that a step be taken of providing a water evacuation port above the water level and a water expulsion apparatus to expel water once it reaches a predetermined depth from the first compartment through the water evacuation port.

It is appreciated that conditions will rapidly change. It is, therefore, preferred that a step be taken of providing first compartment and spillway bar sensors which senses a water level in the settling pond relative to a spillway bar and the body, respectively. The spillway bar and the first compartment sensors are linked to the target liquid transfer apparatus. Operation of the target liquid transfer operation is stopped if the spillway bar and the first compartment sensors sense that a distance between the spillway bar and the water level in the settling pond has fallen below a predetermined distance. The target liquid transfer operation is restarted once the level is determined to be once again high enough.

According to another aspect there is provided, an apparatus for skimming a target liquid floating on water, such as the water of a pond. The apparatus includes a body having a first compartment and a second compartment. The body has adjustable floats, such that the body floats on the water. The body has an opening through which liquids enter the first compartment. A target liquid transfer apparatus is positioned a predetermined distance above the water level of the pond to selectively transfer only the target liquid floating on the water from the first compartment to the second compartment.

There are various types of target liquid transfer apparatus that could be employed. In the embodiment that will hereinafter described, the target liquids transfer apparatus is a liquid adhesion roller with an associated shear bar. The roller is rotated by a motor and, as the roller rotates, the target liquid floating on the water in the first compartment adheres to the roller. The shear bar serves to shear the target liquid from the roller. A flow path is provided from the shear bar to the second compartment whereby the target liquid sheared from the roller by the shear bar flows along the flow path into the second compartment.

A spillway bar with its own floats is set to a desired depth in the target fluid. It is preferred that the spillway bar be height adjustable in order to set a depth of fluid in the first compartment relative to a bottom of the roller (when at rest) as well as the depth of the infeed in the target fluid. The body is then set to the desired depth in the fluid using the body floats.

It is also preferred that water be evacuated from the first compartment with the transfer of the target liquid to the second compartments. In order to accomplish this, the first compartment has a water evacuation port and shroud positioned above the water level and a water expulsion apparatus to expel water from the first compartment to the water evacuation port when the target liquid transfer apparatus is in operation.

There are various water expulsion apparatus that can he employed. In the embodiment that will hereinafter be described the water expulsion apparatus is a rotating gear positioned in a shroud. The shroud serves to isolate the movement of water from the target liquid. The shroud has an upper end and a lower end. A water inlet is positioned toward the lower end of the shroud and the water evacuation port is positioned toward the upper end of the shroud.

In order to use the same motor to drive the drive gear and the roller, it is preferred that the rotating gear be fixed to the roller. The rotating gear is driven by a drive gear from the motor. This also results in the target liquid being picked up by the roller and water concurrently being expelled by the rotating gear with every rotation.

It is preferred that the second compartment is coupled to a pumping apparatus which pumps the target liquid from the second compartment to a remotely located storage.

It is preferred that a spillway bar and first compartment sensors be provided to monitor a water level in the settling pond relative to the spillway bar and the body and a second compartment sensors be provided to monitor the target liquid level in the second compartment.

The spillway bar and the first compartment sensors are preferably linked to the motor for the roller. Upon a signal being received from the spillway bar and the first compartment sensors that the distance between the spillway bar and the water level in the pond has fallen below a predetermined distance, the motor ceases rotation of the roller. The roller is restarted when the sensors determines that the distance to the surface of the water in the pond is sufficient.

The second compartment sensor is preferably linked to the pumping apparatus. Upon a signal being received from the second compartment sensor that the level of the target liquid in the second compartment has fallen below a predetermined minimum level, the pumping apparatus ceases operation. The second compartment sensor is also preferably linked to the motor for the roller. Upon a signal being received from the second compartment sensor that the level of the target liquid in the second compartment has reached a predetermined maximum level, the motor ceases rotation of the roller. Under all other operating conditions, both the motor for the roller and the evacuation pump are in operation.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
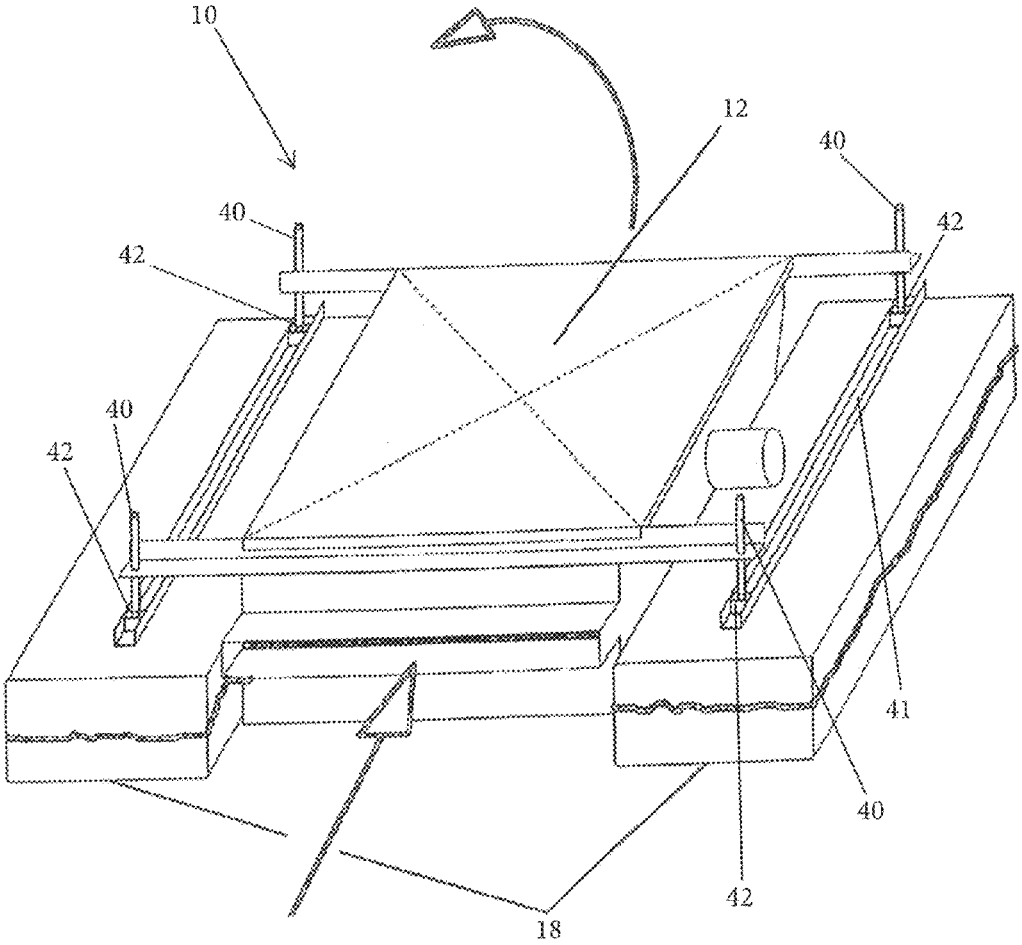
FIG. 1 is a front perspective view of a skimming apparatus.

An Apparatus for skimming target liquid floating on water of a settling pond, the apparatus generally identified by reference numeral 10, will now be described with reference to FIG. 1 through FIG. 5.

Figure 2:
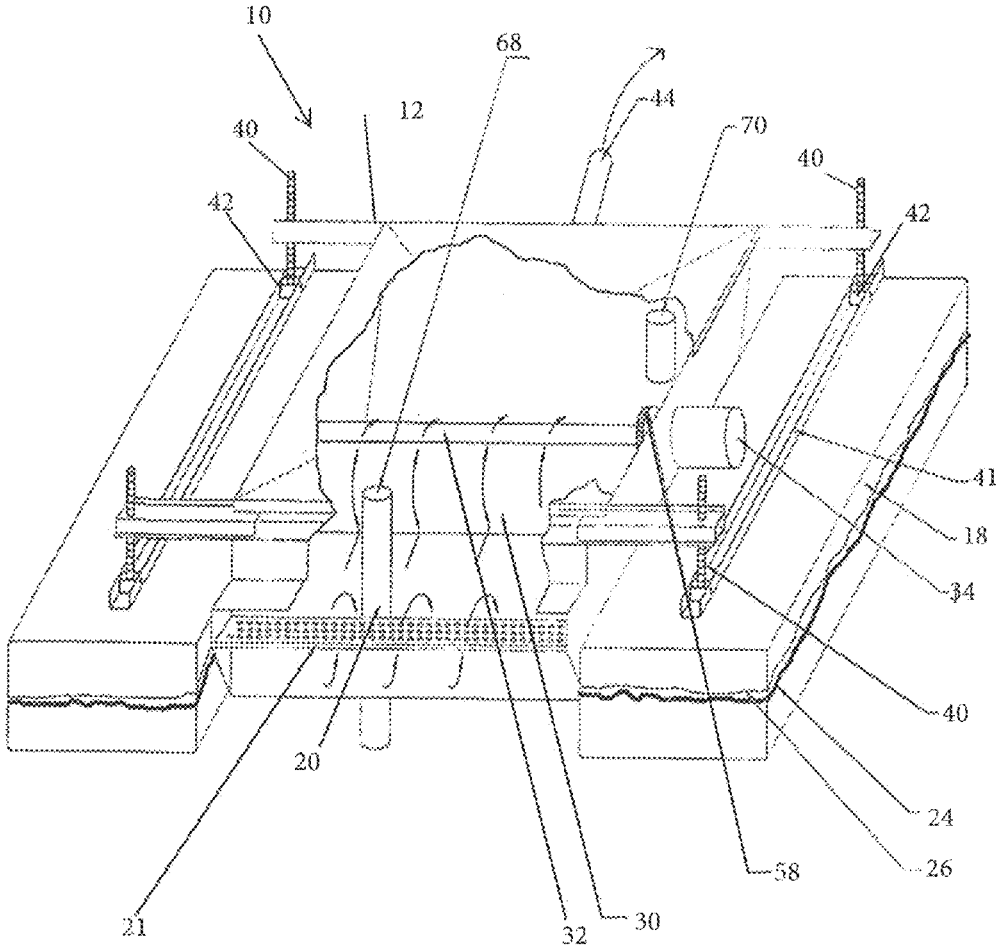
FIG. 2 is a partially cut away front perspective view of the skimming apparatus of FIG. 1.
Figure 3:
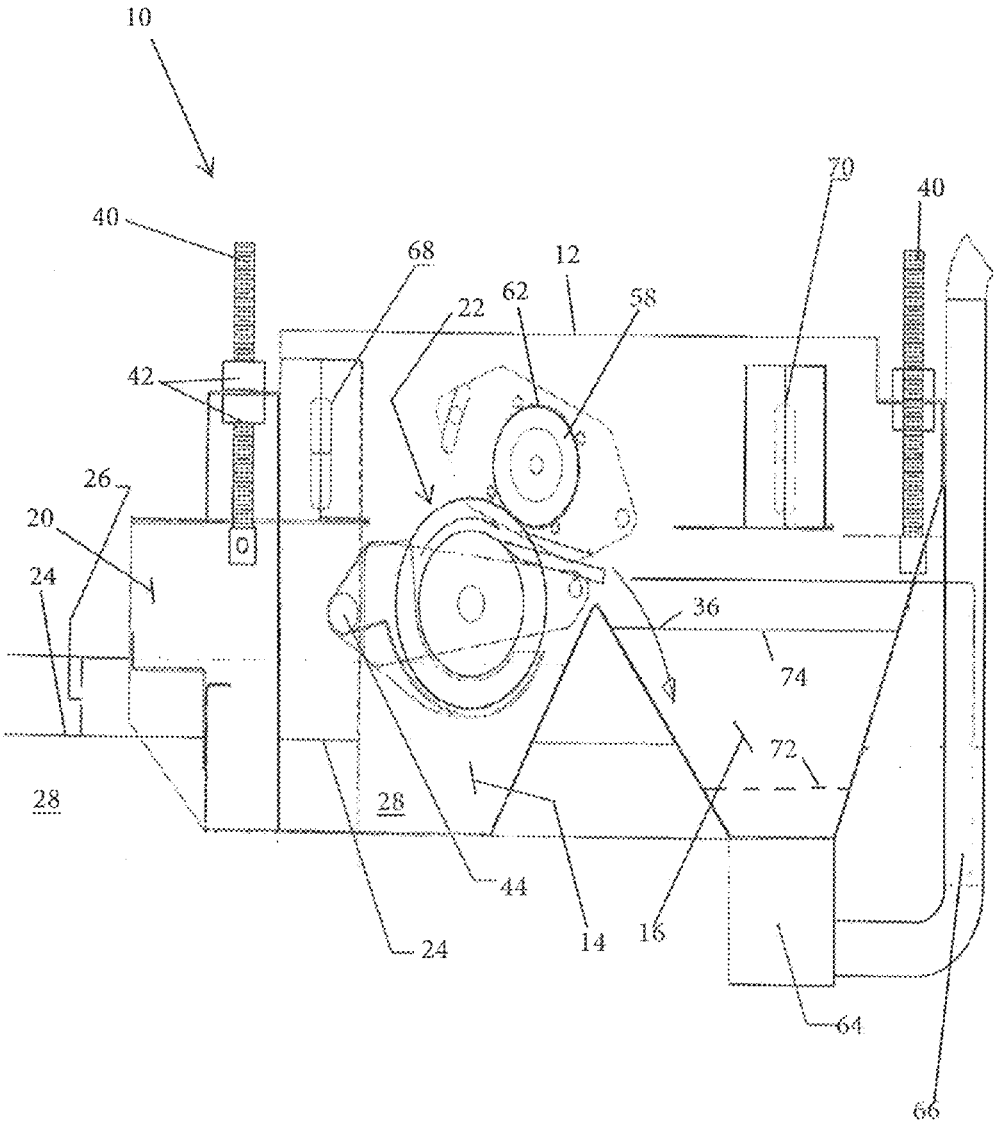
FIG. 3 is a side elevation view, in section, of the skimming apparatus of FIG. 1.
Figure 4:
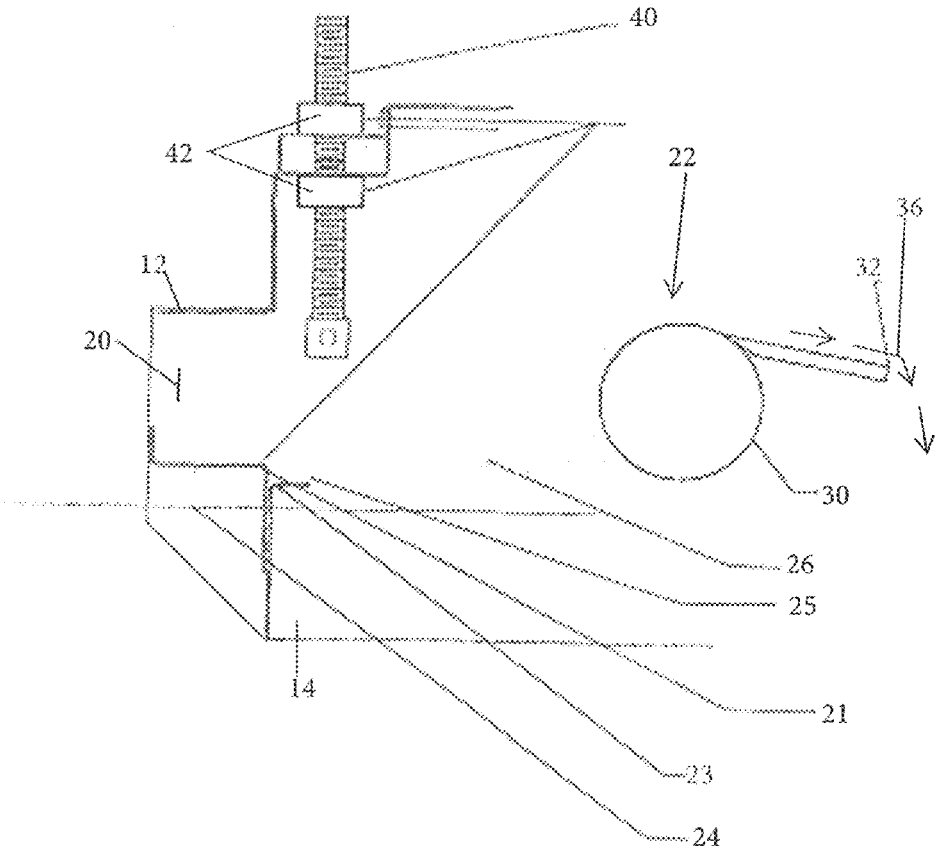
FIG. 4 is a detailed side elevation view, in section, of the opening into the first compartment and the target liquid transfer apparatus (the roller and the shear bar) of the skimming apparatus of FIG. 3.

Structure and Relationship of Parts:

Referring to FIG. 3, apparatus 10 includes a body 12 having first compartment 14 and a second compartment 16. Referring to FIG. 1, body 12 has floats 18, such that body 12 floats water. Referring to FIG. 1 through FIG. 3, body 12 has an opening 20 that serves as a spillway through which liquids enter first compartment 14. Referring to FIG. 2, positioned in opening 30 is an adjustable spillway bar 21. Referring to FIG. 3 and FIG. 4, a target liquid transfer apparatus, generally identified by reference numeral 22, is positioned a predetermined distance above a water level 24 in the settling pond to selectively transfer only the target liquid 26 floating on the water 28 from first compartment 14 to second compartment 16.

Figure 5:
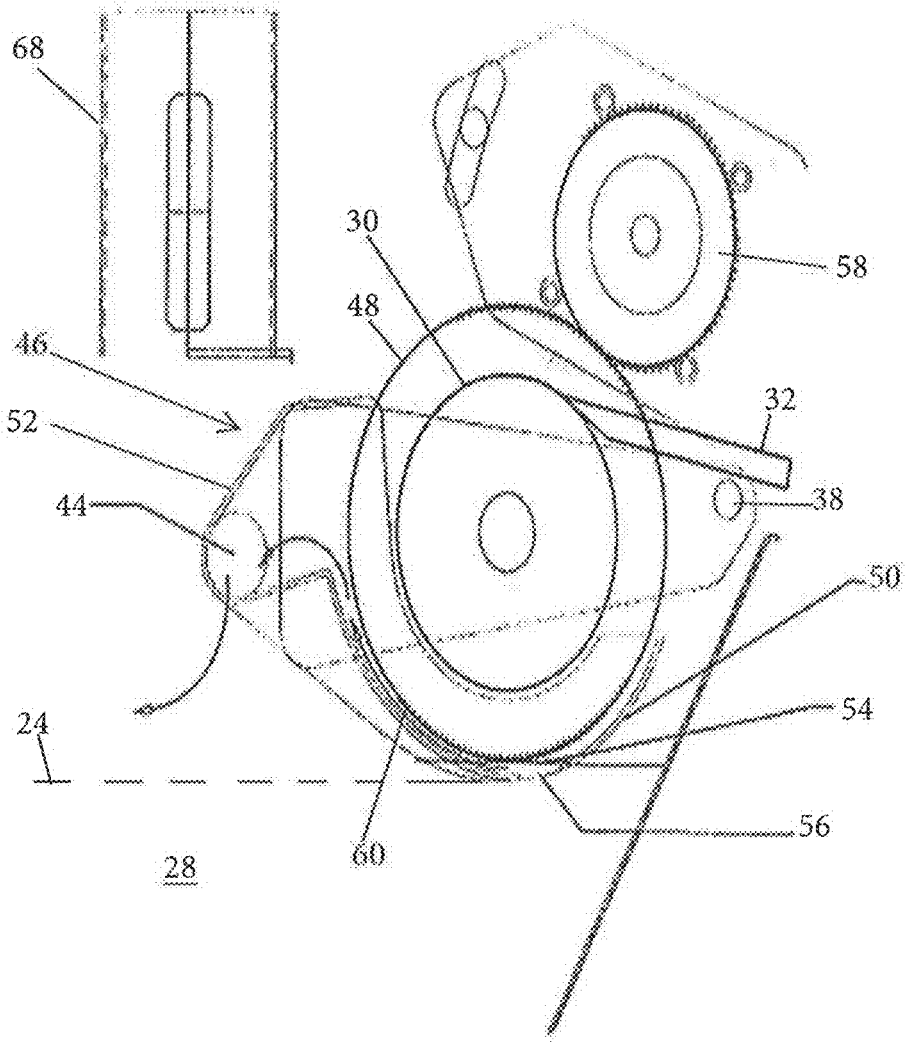
FIG. 5 is a detailed side elevation view, in section, of the water evacuation apparatus (the rotating gear and the shroud) of the skimming apparatus of FIG. 3.
Figure 6:
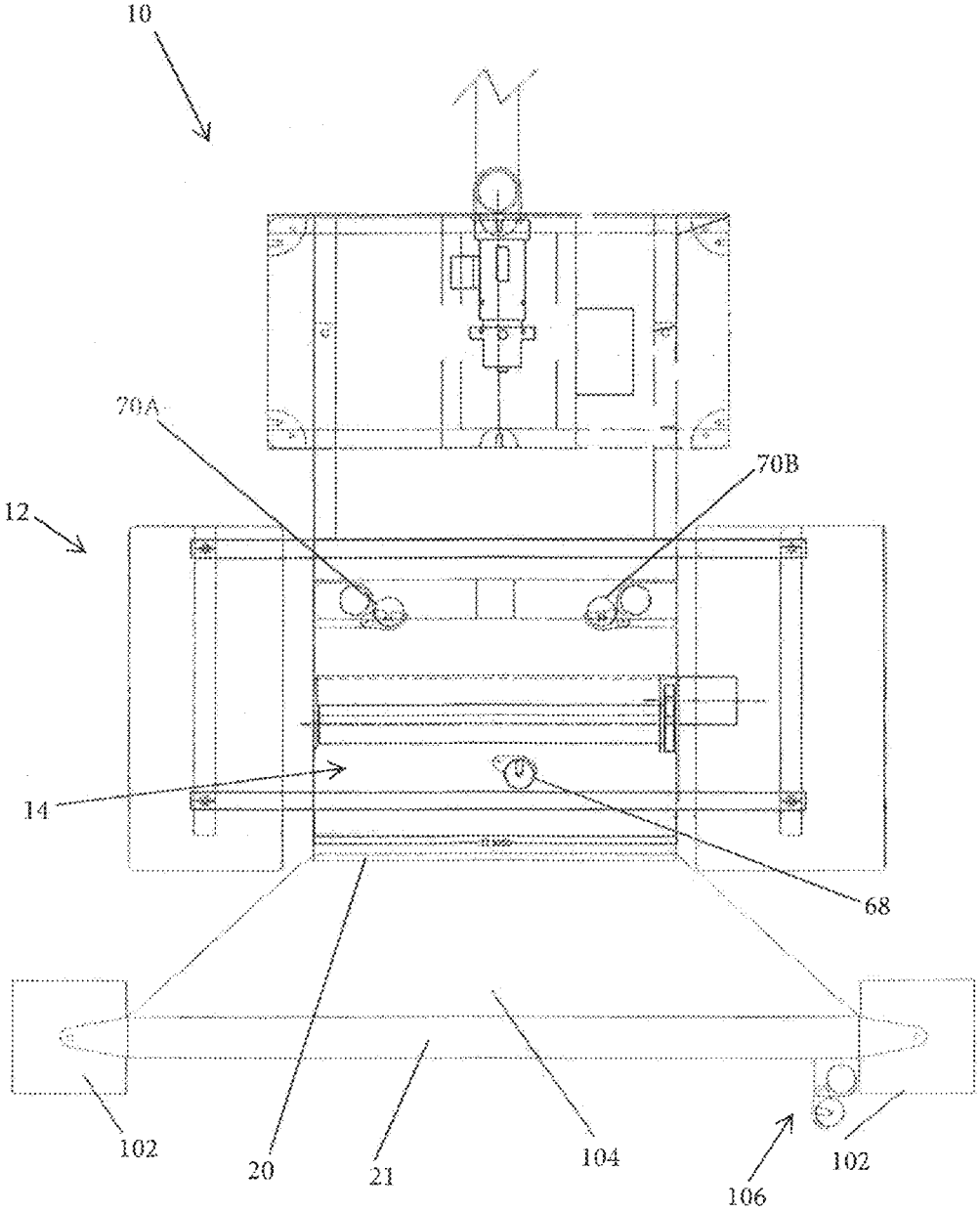
FIG. 6 is a top plan view of the skimming apparatus of FIG. 1 with the addition of a floating high volume spillway bar.

Referring to FIG. 4, target liquids transfer apparatus 22 includes a liquid adhering roller 30 with an associated shear bar 32. Referring to FIG. 3 and FIG. 5, roller 30 is rotated by a motor 34. Referring to FIG. 3 and FIG. 4, as roller 30 rotates, target liquid 26 floating on water 28 in first compartment 14 adheres to roller 30. The shear bar 32 shears target liquid 26 from roller 30. A flow path, shown by arrows 36, is provided from shear bar 32 to second compartment 16. Target liquid 26 sheared from roller 30 by shear bar 32 flows along flow path 36 into second compartment 16.

Referring to FIG. 3 and FIG. 5, shear bar 32 is pivotally mounted for pivotal movement about pivot axis 38. This allows shear bar 32 to be adjustable relative to roller 30.

Referring to FIG. 4, there is shown a spillway bar 21 positioned across opening 20. It is preferred that spillway bar 21 he height adjustable in order to set a depth of fluid in the first compartment 14 relative to a bottom of roller 30, as well as the depth of spillway bar 21 in the target liquid. This adjustment is useful in ensuring that a bottom of roller 30 is positioned in the fluid a desired distance. An additional form of adjustment is to have spillway bar 21 vertically adjustable relative to floats 18. This enables opening 20 through which liquids enter first compartment 14 to be adjustable by raising or lowering body 12 relative to the two floats 18 on body 12. Referring to FIG. 1, body 12 is attached to floats 18 by four bolts 40, positioned in float channels 41. Referring to FIG. 3, each of bolts 40 has two nuts 42. By rotating bolts 40 in a clockwise or counterclockwise direction, body 12 can be levelled or vertically adjusted relative to floats 18. This enables opening 20 through which liquids enter first compartment 14 to be adjusted. A difference in adjustment may be better understood by comparing the positioning of nuts 42 in FIG. 3 with the positioning of nuts 42 in. FIG. 4. Spillway bar 21 defines air infeed 23. It is generally desirable for infeed 23 to be positioned one quarter of an inch above the bottom of roller 30, as indicated by reference numeral 25.

Referring to FIG. 3 and FIG. 5, first compartment 14 has a water evacuation port 44 positioned above water level 24 and a water expulsion apparatus, generally indicated by reference numeral 46, to expel water from first compartment 14 out through water evacuation port 44. Water expulsion apparatus 46 is in the form of a rotating gear 48 positioned in a shroud 50. Shroud 50 serves to isolate the movement of expelling water from target liquid 26. Shroud 50 has an upper end 52 and a lower end 54. A water inlet 56 is positioned toward lower end 54 of shroud 50. Water evacuation port 44 is positioned toward upper end 52 of shroud 50.

Referring to FIG. 3 and FIG. 5, in order to use motor 34 to drive both rotating gear wheel 48 and roller 30, it is preferred that gear 48 be fixed to roller 30. Rotating gear 48 is driven by a drive gear 58 from motor 34. As will hereinafter be further described, this results in target liquid 26 being picked up by roller 30 and water being expelled by rotating gear 48 with every rotation. It will be appreciated that teeth 60 of gear 48 are meshing with teeth 62 of drive gear 58. It will also be appreciated that teeth 60 of gear 48 are serving as blades to push water entering water inlet 56 along shroud 50 to water evacuation port 44.

Referring to FIG. 3, second compartment 16 has a pumping apparatus 64, in the form of a sump pump, to pump target liquid 26 from second compartment 16 along conduit 66 to a remotely located storage facility located on shore (not shown).

Referring to FIG. 2 and FIG. 3, a first compartment sensor 68 is provided to monitor water level 24 in the settling pond relative to the spillway bar 21. In this embodiment, a first level sensing tube serves first compartment sensor 68. A second compartment sensor 70 is provided to monitor target liquid 26 level in second compartment 16. In this embodiment, a second level sensing tube serves as second compartment sensor 70.

Referring to FIG. 3 and. FIG. 5, first compartment sensor 68 is preferably linked to motor 34 for roller 30. Upon a signal being received from first compartment sensor 68 that the distance between spillway bar 21 and water level 24 in the settling pond has fallen below the predetermined distance, motor 34 ceases rotation of roller 30.

Referring to FIG. 3 and FIG. 5, second compartment sensor 70 is preferably linked to pumping apparatus 64. Upon a signal being received from second compartment sensor 70 that the level of target liquid 26 in second compartment 16 has fallen below a predetermined minimum level (indicated by reference numeral 72), pumping apparatus 64 ceases operation. Second compartment sensor 70 is also preferably linked to motor 34 for roller 30. Upon a signal being received from second compartment sensor 70 that the level of target liquid 26 in second compartment 16 has reached a predetermined maximum level (indicated by reference numeral 74), motor 34 ceases rotation of roller 30. During normal operation both motor 34 and pumping apparatus 64 are in operation.

It should be noted that the sensor configurations may vary depending upon the type of sensors that are used. It is possible to assign different functions to different sensors or different pairs of sensors. This would increase the number of sensors, as you could potentially have a pair of sensors to stop a function and a pair of sensors to start a function.

Operation:

Referring to FIG. 1, body 12 is attached to floats 18 by bolts 40. Referring to FIG. 3, by rotating bolts 40 in a clockwise or counter-clockwise direction, body 12 is levelled and vertically adjusted relative to floats 18 to position spillway bar 21 of opening 20 through which liquids enter first compartment 14. Spillway bar 21 prevents debris from entering opening 20. Spillway bar 21 is capable of further more refined height adjustment for the purpose of positioning fluid levels one quarter of an inch above the bottom of roller 30.

Referring to FIG. 3 and FIG. 5, shear bar 32 is adjusted by pivoting about pivot axis 38 for the purpose of positioning shear bar 32 in relation to roller 30.

Referring to FIG. 3 and FIG. 5, upon motor 34 being activated, gear 48 is driven by drive gear 58 from motor 34. This results in concurrent rotation of roller 30 and water being expelled by the rotation of gear 48.

Referring to FIG. 3 and FIG. 4, as roller 30 rotates, target liquid 26 floating on water 28 in first compartment 14 adheres to roller 30. Shear bar 32 shears target liquid 26 from roller 30. Target liquid 26 sheared from roller 30 by shear bar 32 flows along flow path 36 into second compartment 16.

Referring to FIG. 3 and FIG. 5, first compartment 14 has water evacuation port 44 positioned above water level 24. Rotating gear 48 directs water from water inlet 56 to water evacuation port 44. Gear 48 is positioned in shroud 50 to prevent the movement of expelled water from disturbing target liquid 26.

Referring to FIG. 3, pumping apparatus 64 pumps target liquid 26 from second compartment 16 along conduit 66 to a remotely located storage facility located on shore (not shown).

Referring to FIG. 3 and FIG. 5, upon a signal being received from first compartment sensor 68 that the distance between spillway bar 21 and water level 24 in the settling pond has fallen below the predetermined distance, motor 34 ceases rotation of roller 30. This prevents water from being transferred by roller 30 into second compartment 16.

Referring to FIG. 3 and FIG. 5, upon a signal being received from second compartment sensor 70 that the level of target liquid 26 in second compartment 16 has fallen below predetermined minimum level 72, pumping apparatus 64 ceases operation. This prevents pumping apparatus 64 from running dry and drawing air.

Referring to FIG. 3 and FIG. 5, upon a signal being received from second compartment sensor 70 that the level of target liquid 26 in second compartment 16 has reached a predetermined maximum level 74, motor 34 ceases rotation of roller 30. This prevents target liquid 26 from overflowing second compartment 16.

Figure 7:
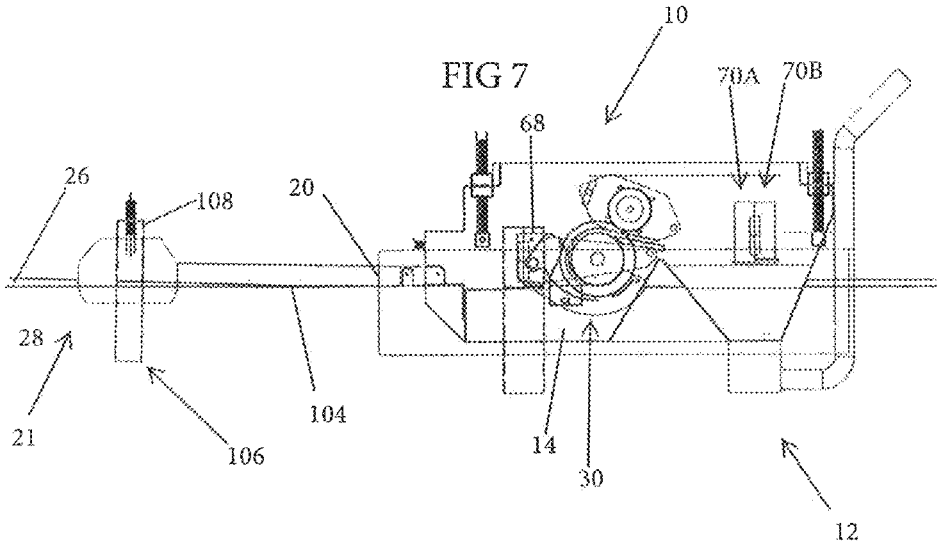
FIG. 7 is a side elevation view of the skimming apparatus of FIG. 6, with the floating high volume spillway bar at a low level shutdown point.
Figure 8:
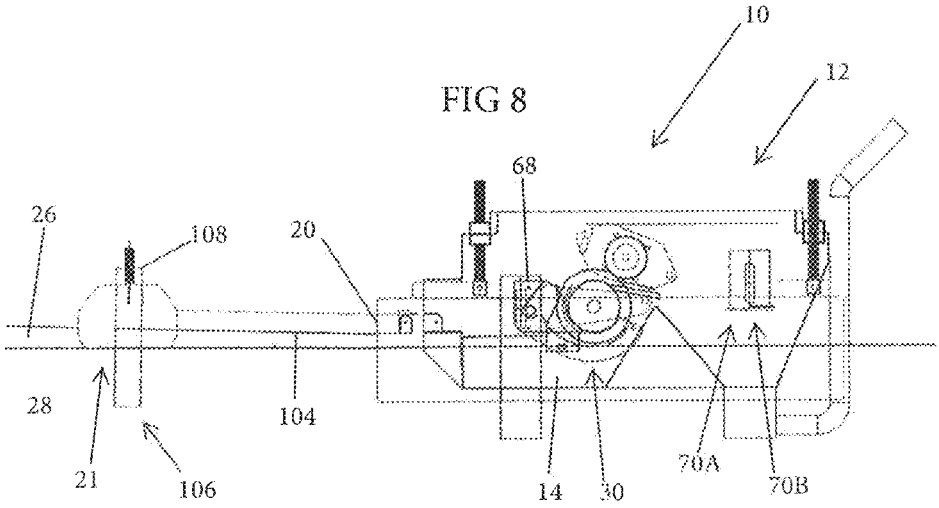
FIG. 8 is a side elevation view of the skimming apparatus of FIG. 6, with the floating high volume spillway bar at a high level start-up point.

Variation:

Referring to FIG. 6 through FIG. 10 there are illustrated improvements made to the proto-type for apparatus 10 after testing. Referring to FIG. 6 through 9, one improvement was made to the spillway to facilitate higher volume flows while limiting the entry of water into first compartment 14. Spillway bar 21 is now spaced from body 12 and supported by spillway bar floats 102. A flexible membrane 104 extends from opening 20 of body 12 to spillway bar 21, such that liquids which pass over spillway bar 21 flow down flexible membrane 104 through opening 20 into first compartment 14. Spillway bar 21 now has a S spill-way bar sensor 106. Spillway bar sensor 106 consists of a tube 108 with a float 110 that floats up and down within tube 108. On top of float 110 is positioned a magnet 112, that moves up and down with the movement of float 110. Suspended in tube 108 above float 110 is a sensing element 114 that senses the presence of magnet 112. Referring to FIG. 7, spillway bar sensor 106 sends a signal to stop the operation of collection roller 30 when the level of target liquid 26 floating on water 28 is so low that there is a danger of directing water 28 into first compartment 14. Referring to FIG. 8, spillway bar sensor 106 sends a signal to initiate the operation of collection roller 30 when the level of target liquid 26 floating on water 28 is sufficient to resume operations.

Figure 9:
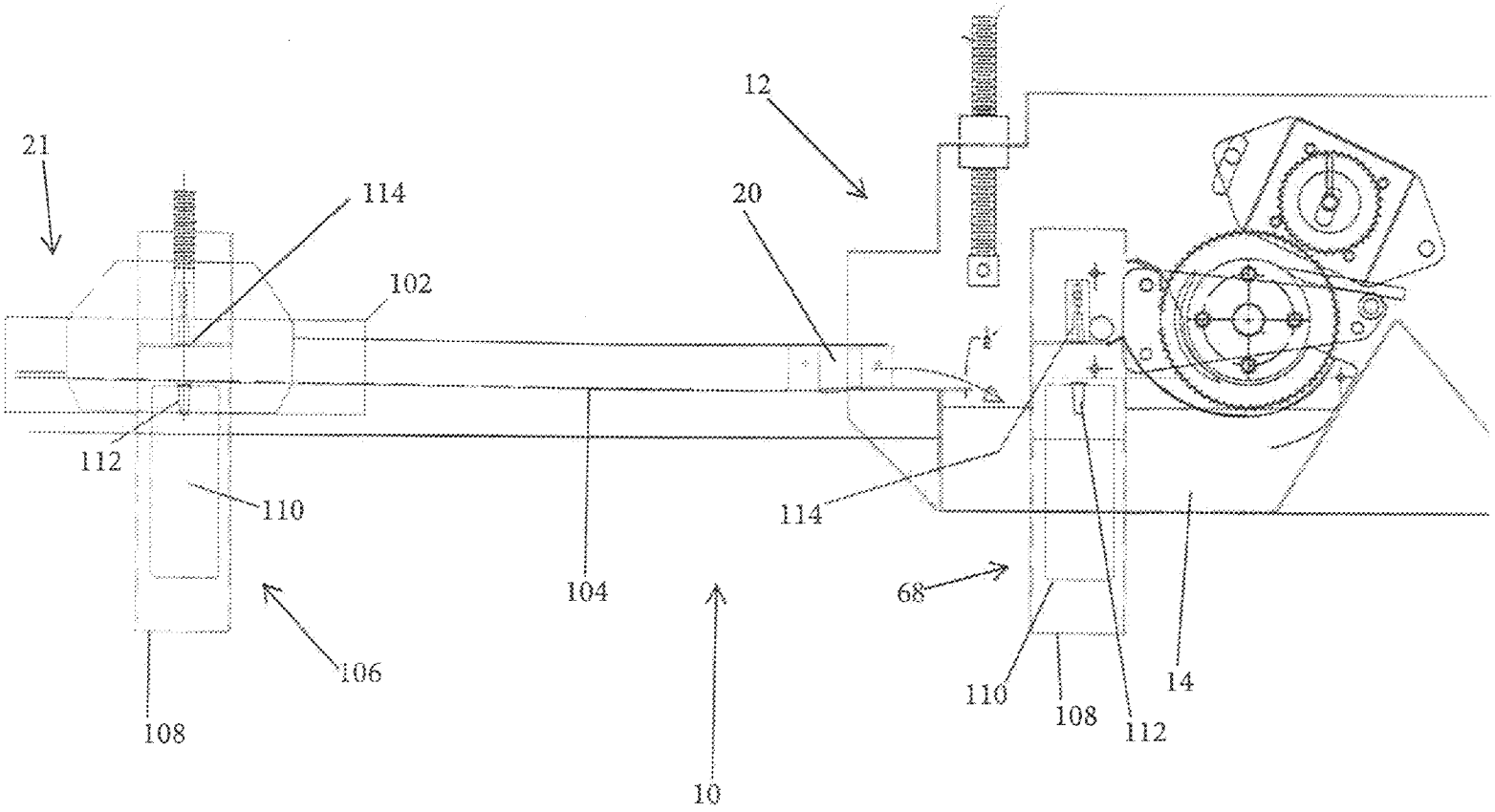
FIG. 9 is a side elevation view, in section, of the skimming apparatus with floating high volume spillway bar of FIG. 6, showing a first compartment sensor.
Figure 11:
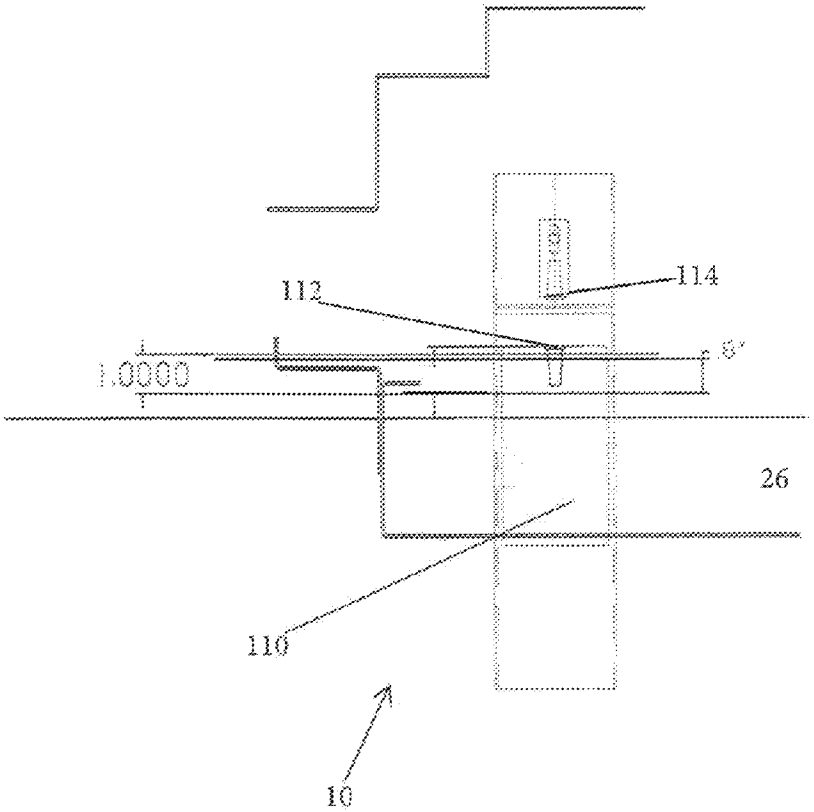
FIG. 11 is a side elevation view, in section, of the skimming apparatus with floating spillway bar of FIG. 6, showing a first compartment sensor of FIG. 9 showing a low level position that triggers shutdown of the collection roller.
Figure 10:
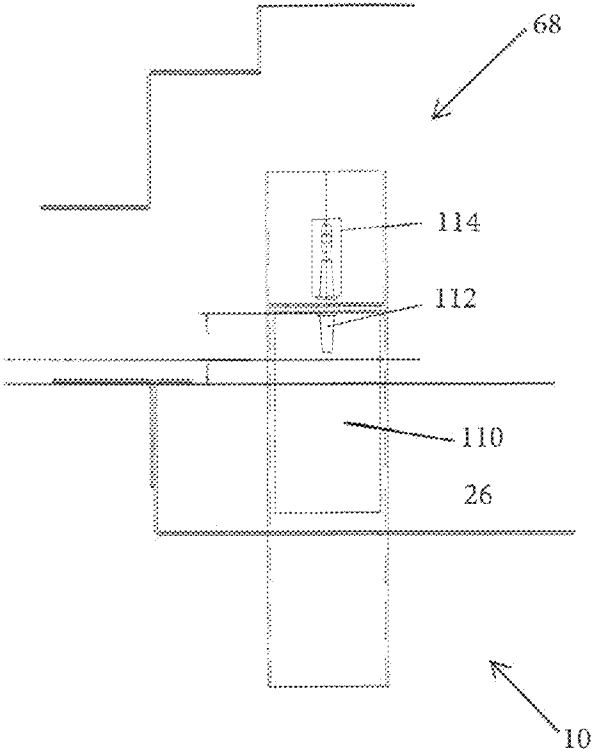
FIG. 10 is a side elevation view, in section, of the first compartment sensor of FIG. 9 showing a high level position that triggers the start-up of the collection roller.

Referring to FIG. 9, an updated version of first compartment sensor 68 is illustrated. First compartment sensor 68 is similar in structure to spillway bar sensor 106. First compartment sensor 68 consists of a tube 108 with a float 110 that floats up and down within tube 108. On top of float 110 is positioned a magnet 112, that moves up and down with the movement of float 110. Suspended in tube 108 above float 110 is a sensing element 114 that senses the presence of magnet 112. Referring to FIG. 10, when the level of target liquid 26 lifts float 110 to a level in which sensing element 114 of first compartment sensor 68 senses magnet 112, a signal is sent to initiate the operation of collection roller 30. Referring to FIG. 11, when the level of target liquid 26 falls drawing float 110 downward to a level in which sensing element 114 can no longer detect magnet 112, shut down control is transferred back to sensor 108.

Figure 12:
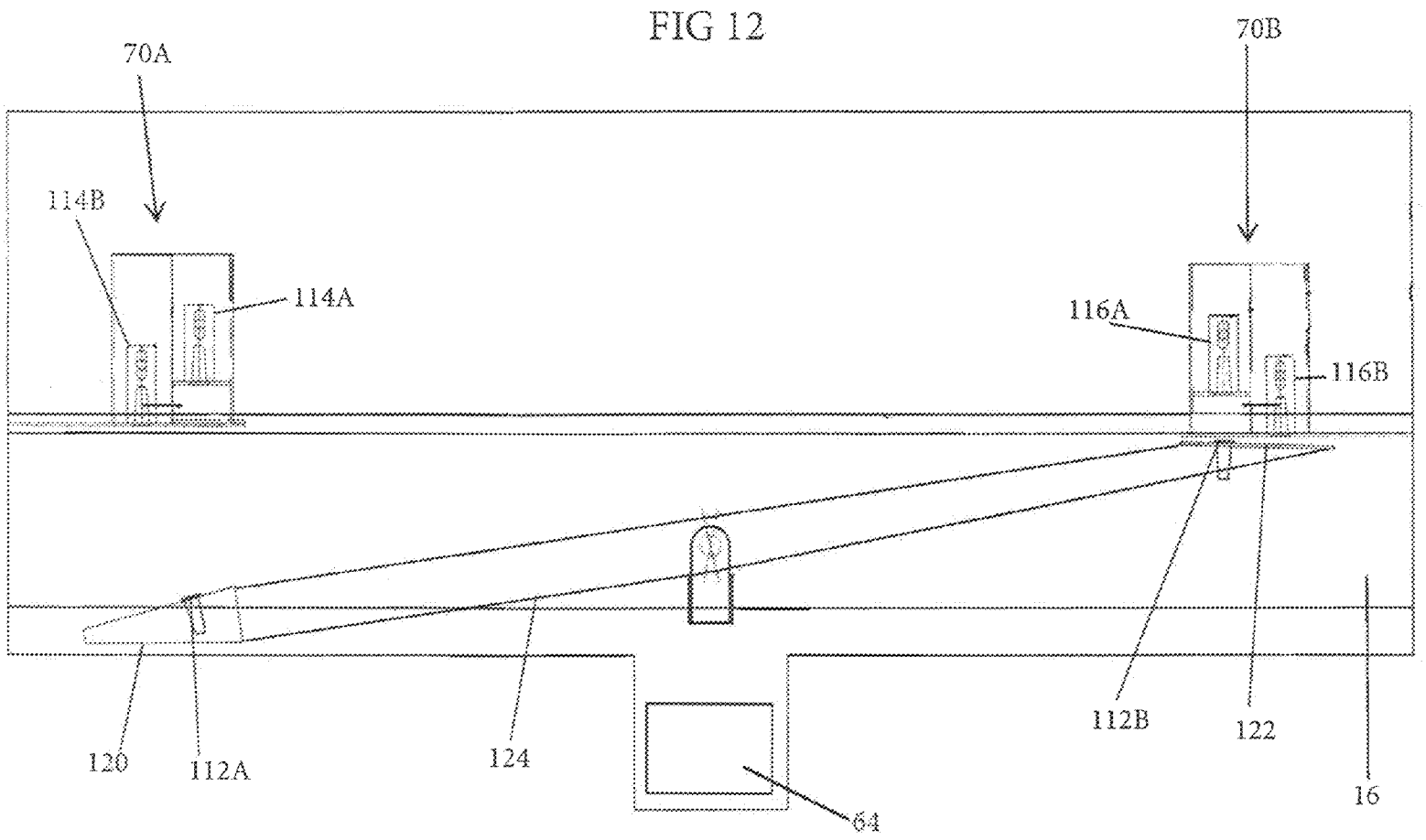
FIG. 12 is a side elevation view, in section, of the skimming apparatus with floating spillway bar of FIG. 6, showing a second compartment sensor having a tipper bar with the tipper bar in a first position.
Figure 13:
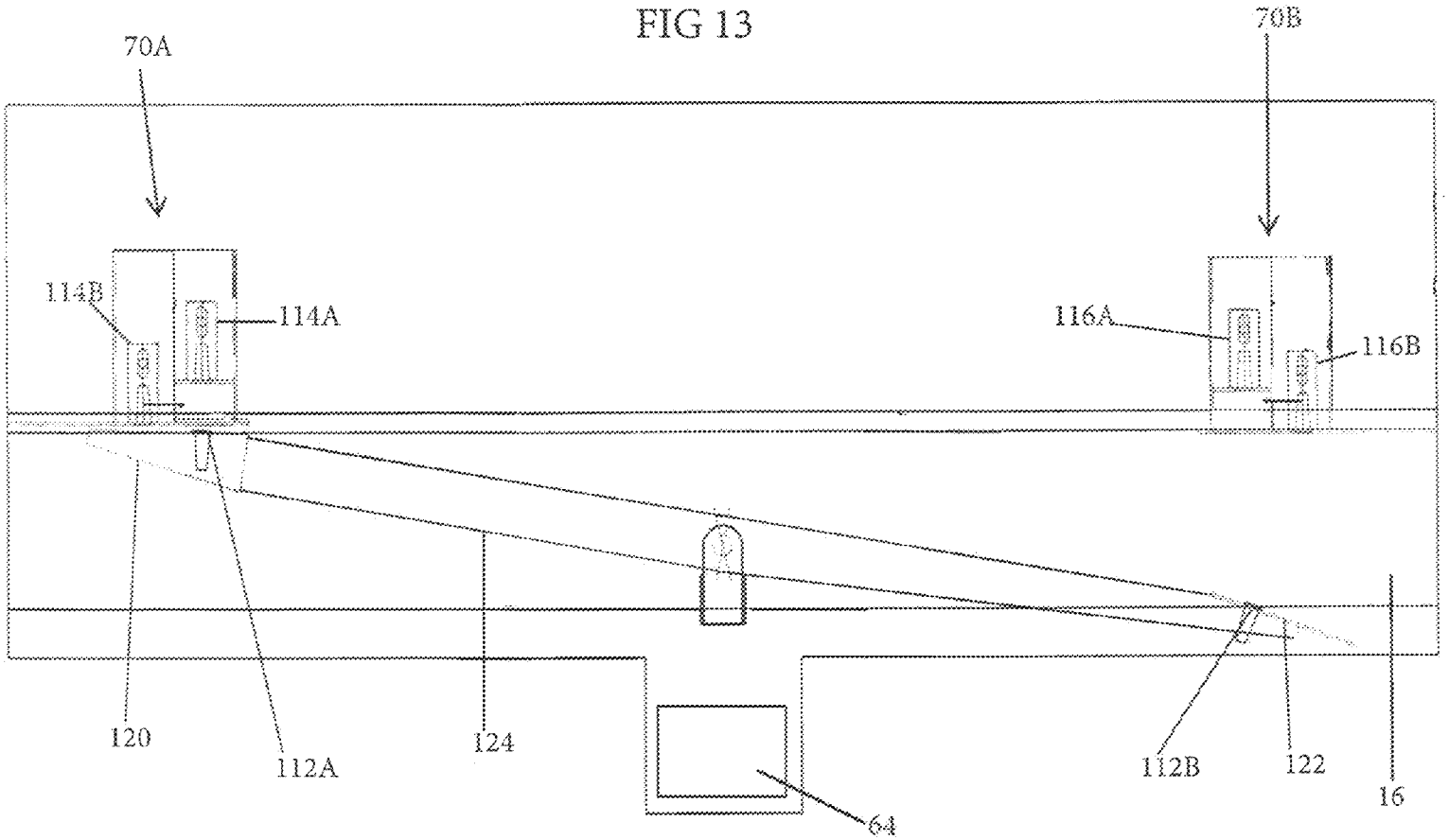
FIG. 13 is a side elevation view, in section, of the skimming apparatus with floating spillway bar of FIG. 6, showing the second compartment sensor having a tipper bar of FIG. 12 with the tipper bar in a second position.

As described above, first compartment sensor 68 turns collection roller 30 on and off In contrast, second compartment sensor 70 must selectively turn on and off both collection roller 30 and also pumping apparatus 64 which operates to pump accumulated liquids from second compartment 16. It is not just a simple on and off, as at certain times both collection roller 30 and pumping apparatus 64 should be in operation. Referring to FIG. 12 and FIG. 13, there is disclosed details of second compartment sensor 70. Second compartment sensor consists of a first sensing unit 70A that controls collection roller 30 and a second sensing unit 70B that controls pumping apparatus 64. In order to link the operation of first sensing unit 70A and second sensing unit 7013 a float 120 which interacts with first sensing unit 70A and a trigger plate 122 that interacts with second sensing unit 70B are connected by a teeter totter arrangement with a connective tipper bar 124 supported on a fulcrum. Float 120 rises and falls depending upon the level of liquid in second compartment 16. Trigger plate 122 is moved up and down by tipper bar 124, depending upon the positioning of float 120. Float 120 has a magnet 112A that rises and falls with float 120. First sensing unit 70A has two sensing elements 114A and 114B that are capable of detecting the proximity of magnet 112A. Sensing element 114A is responsible for the shutdown of collection roller 30. Sensing element 114B is responsible for restarting collection roller 30. Referring to FIG. 13, when sensing element 114A senses the proximity of magnet 112A, it is an indication that second compartment 16 is becoming full and can no longer accept the transfer of more of target liquid 26 by collection roller 30. Sensing unit 70A then shuts down collection roller 30. If sensing element 114A were the only sensing element, as soon as float 120 fell out of the range of sensing element 114A, collection roller 30 would immediately resume operation. This is not desirable as it is would result in frequent short cycles. Instead, once sensing element 114A is triggered, control is shifted to second sensing unit 70B.

Trigger plate 122 has a magnet 112B that rises and falls with trigger plate 122. As previously described, trigger plate 122 rises and falls based upon the position of float 120 due to the inverse relationship of float 120 and trigger plate 122 created by tipper bar 124. Second sensing unit 70B has two sensing elements 116A and 116B that are capable of detecting the proximity of magnet 112B. Sensing element 116B is responsible for starting pumping apparatus 64. Sensing element 116A is responsible for the shutdown of pumping apparatus 64. Referring to FIG. 13, when sensing unit 114A of first sensing unit 70A detects magnet 112A, control is transferred to second sensing unit 114B of 70A. If sensing unit 116B in the second sensing unit 70B does not detect magnet 112B, evacuation pumping apparatus 64 is started and the level of target liquid 26 is second compartment 16 begins to go down. Referring to FIG. 12, when sensing unit 116B in unit 70B detects the presence of magnet 112A, it can only mean that the level of target liquid 26 in second compartment 16 has gone down to the point that trigger plate 122 is approaching sensing unit 116B. Control is then transferred back to first sensing unit 70A. If sensing unit 114B of first sensing unit 70A does not detect the presence of magnet 112A, collection roller 30 is restarted and target liquid 26 enters and stars to refill second compartment 16. It is to be noted sensor "A" is the higher of the two and causes shut down. Sensor B in all cases is the lower of the two and triggers start up.

In this patent document, the word "comprising" is used in its nonlimiting sense to mean that items following the word are included, but items not specifically mentioned are not excluded. A reference to an element by the indefinite article "a" does not exclude the possibility that more than one of the element is present, unless the context clearly requires that there be one and only one of the elements.

The illustrated embodiments have been set forth only as examples and should not be taken as limiting a purposive interpretation of the claims.

What is claimed is:

1. An apparatus for skimming a target liquid floating on water of a settling pond, comprising:

a body having a first compartment and a second compartment, the body having floats, such that the body floats on the water, the body having an opening through which liquids enter the first compartment; and a target liquid transfer apparatus positioned a predetermined distance above a water level in the first compartment to selectively transfer only a target liquid floating on the water from the first compartment to the second compartment, the target liquids transfer apparatus is a liquid adhering roller with an associated shear bar, the roller is rotated by a motor, as the roller rotates the target liquid floating on the water in the first compartment adheres to the roller, the shear bar shears the target liquid from the roller, a flow path is provided from the shear bar to the second compartment whereby the target liquid sheared from the roller by the shear bar flows along the flow path into the second compartment;

a spillway bar positioned across the opening to set a depth of infeed of the target liquid and to establish a relationship of the spillway bar and a bottom of the roller, the spillway bar is supported by floats, such that the spillway bar floats up and down dependent upon the level of target liquid floating on the body of water;

a flexible membrane extends from the opening of the body to the spillway bar, such that liquid, which passes over the spillway bar, flows down the flexible membrane through the opening into the first compartment, and a spillway bar sensor monitors a water level in the settling pond relative to the spillway bar, the spillway bar sensor being linked to the motor of the roller such that when a signal is received that a level of the target liquid floating on the body of water, as indicated by a distance of the spillway bar to the surface of the water on the pond, is less than a predetermined limit, the rotation of the roller ceases.

2. The apparatus of claim 1, wherein the body is vertically adjustable relative to the floats for the body, the opening through which liquids enter the first compartment being adjustable by raising or lowering the body relative to the floats.

3. The apparatus of claim 1, wherein the first compartment has a water evacuation port positioned above the water level and a water expulsion apparatus is provided to continuously expel water from the first compartment to the water evacuation port.

4. The apparatus of claim 3, wherein the water expulsion apparatus is a rotating gear positioned in a shroud, the shroud having an upper end and a lower end, with a water inlet positioned toward the lower end and the water evacuation port positioned toward the upper end.

5. The apparatus of claim 4, wherein the rotating gear is fixed to the roller, the rotating gear being driven by a drive gear from the motor, such that the roller is rotated and concurrently water is expelled from the shroud through the water evacuation port.

6. The apparatus of claim 1, wherein a first compartment sensor is provided which monitors the water level in the settling pond relative to the body, the first compartment sensor is linked to the motor for the roller such that, upon a signal being received from the first compartment sensor that the distance between the spillway bar and the water level in the settling pond has risen to a sufficient height, the motor resumes rotation of the roller.

7. The apparatus of claim 1, wherein the second compartment is coupled to a pumping apparatus which pumps the target liquid from the second compartment.

8. The apparatus of claim 1, wherein the second compartment has a second compartment sensor that monitors a level of the target liquid which has accumulated in the second compartment.

9. The apparatus of claim 7, wherein the second compartment has a second compartment sensor that monitors a level of the target liquid which has accumulated in the second compartment, the second compartment sensor is linked to the pumping apparatus, upon a signal being received from the second compartment sensor that the level of the target liquid in the second compartment has fallen below a predetermined minimum level, the pumping apparatus ceases operation.

10. The apparatus of claim 1, wherein the second compartment has a second compartment sensor that monitors a level of the target liquid which has accumulated in the second compartment, the second compartment sensor is linked to the motor for the roller, such that, upon a signal being received from the second compartment sensor that the level of the target liquid in the second compartment has reached a predetermined maximum level, the motor ceases rotation of the roller.

11. The apparatus of claim 1, wherein the shear bar is pivotally mounted and pivots for positioning relative to the roller.

12. The apparatus of claim 6, wherein the first compartment sensor and the spillway bar sensor are each comprised of:

a tube;

a float that floats up and down within the tube based upon a liquid level within the tube;

a magnet positioned on top of the float that moves up and down with the movement of the float; and a sensing element positioned to sense the presence of the magnet.

13. The apparatus of claim 8, wherein the second compartment sensor is comprised of:

a teeter totter sensor configuration having a tipper bar resting on a fulcrum, and the tipper bar having a first end and a second end;

a float mounted to the first end of the tipper bar;

an actuator mounted to the second end of the tipper bar;

a first sensing unit that is triggered by the proximity of the float; and a second sensing unit that is triggered by the proximity of the actuator.

14. The apparatus of claim 13, wherein a first magnet is carried by the float, a second magnet is carried by the actuator, the first sensing unit having a magnetically triggered collection roller shutdown sensor and a magnetically triggered collection roller start up sensor; and the second sensing unit having a magnetically triggered pumping apparatus start up sensor and a magnetically triggered pumping apparatus shutdown sensor, control being passed back and forth between the first sensing unit to the second sensing unit.

* * * * *